United States Patent [19]

Wittenmyer

[11] 4,072,168

[45] Feb. 7, 1978

[54] DUAL STANDPIPE ARRANGEMENT SUPPLEMENTING A WATER SUPPLY SYSTEM

[76] Inventor: James D. Wittenmyer, 853 Granada Drive, Greenwood, Ind. 46142

[21] Appl. No.: 740,535

[22] Filed: Nov. 10, 1976

[51] Int. Cl.[2] ..... E03B 5/00

[52] U.S. Cl. ..... 137/567; 417/6; 417/38; 137/113; 137/207.5; 137/568; 137/592; 137/593

[58] Field of Search ..... 137/568, 592, 593, 207.5, 137/209, 211, 256, 566, 565, 567, 113; 417/3, 6, 36, 38

[56] References Cited

U.S. PATENT DOCUMENTS

| | | | |
|---|---|---|---|
| 254,944 | 3/1882 | Evans | 417/38 |
| 1,482,376 | 2/1924 | Anderson | 137/593 |
| 1,750,543 | 3/1930 | Pulford | 137/211 |
| 2,956,581 | 10/1960 | Pearson | 417/38 |
| 3,035,522 | 5/1962 | Lung | 137/211 |
| 3,201,942 | 8/1965 | Yamamoto | 137/593 |
| 3,357,359 | 12/1967 | Schaub | 417/3 |
| 3,493,001 | 2/1970 | Bevandich | 137/565 |
| 3,625,858 | 12/1971 | Conn | 137/209 |
| 3,794,789 | 2/1974 | Bynum | 417/38 |
| 4,019,528 | 4/1977 | Tyrrell | 137/209 |

*Primary Examiner*—William R. Cline
*Assistant Examiner*—H. Jay Spiegel
*Attorney, Agent, or Firm*—Jerome P. Bloom

[57] ABSTRACT

For use in connection with a water supply system wherein pumping means draws water from a source and supplies it to various consumers by way of a main and branch lines from a main, a supplement to said supply system including a tank forming a first large standpipe for storage of water and a second smaller standpipe. The second standpipe is positioned within said first standpipe to project upwardly from and perpendicular to its bottom to a level approaching but spaced from the top of said first standpipe. A distribution line is provided one end of which opens into the bottom of said first standpipe and the other end of which is arranged to connect to said main. The lower end of said second standpipe, which opens from the bottom of said tank, has coupled thereto one end of a first flow line the opposite end of which is arranged to connect to said main. Said second standpipe provides means through which water may be delivered to fill and/or replenish the supply of water in the interior of said first standpipe, while said distribution line provides means for the delivery of water from said first standpipe when the water therein reaches a predetermined level. Said second standpipe has in connection therewith means which respond to the sensing of the water pressure in the related main, as represented by the level thereof in the second standpipe, to induce the delivery of water from said first standpipe to said main in a manner and under conditions to maintain the supply in said main and at a predetermined level of pressure such as required to satisfy the various consumers.

12 Claims, 2 Drawing Figures

DUAL STANDPIPE ARRANGEMENT SUPPLEMENTING A WATER SUPPLY SYSTEM

BACKGROUND OF THE INVENTION

Figure 1:
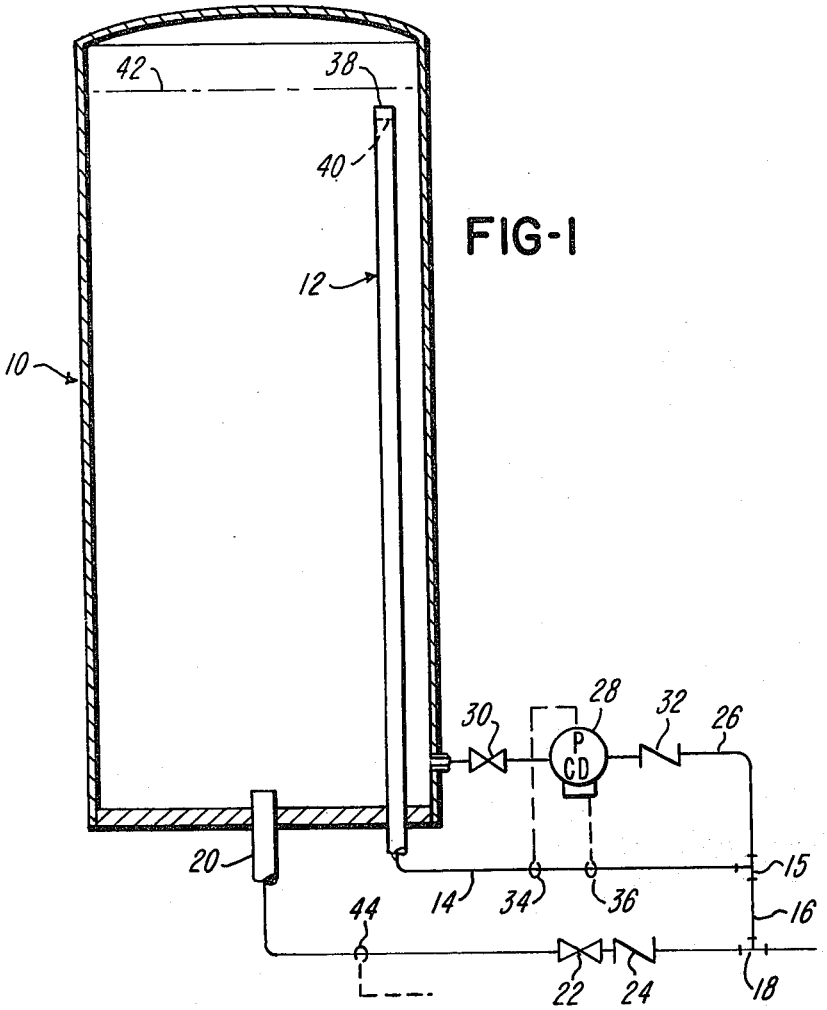

This invention relates to improvements in water supply systems which render them not only economical to operate during peak demand periods but more efficient and satisfactory in use, automatically adaptable to changing levels of demand and unlikely to malfunction. It enables optimal service while minimalizing the investment in capital equipment.

Embodiments feature a dual standpipe storage structure so related to both the supply main and the source which feeds the water supply system as to enable an essentially complete utilization of its total capacity. The use of the invention insures each consumer an adequate supply of water under adequate pressure at all times.

From the standpoint of economy a conventional installation for pumping water from a primary source to a given community will not be designed to meet peak load conditions at all times. The equipment required to this end is much too costly and it is highly undesirable to have and to be required to maintain equipment which has only limited periods of function. Apart from this, it is often impossible to foresee an unexpected population explosion in a community.

It is for reasons such as the foregoing that conventional installations usually include a standby storage tank containing water which can be fed into the main or mains of the related water supply system as the pressure in this system inherently drops during peak demand periods. While such arrangements will serve a useful purpose, it is often found they far from satisfy needs during peak periods. When the problem in this respect becomes particularly severe, there is no alternative but to expand the basic water supply system, such as by adding another well as an additional source of supply, together with the highly expensive pumping and filtering equipment required to utilize the water made available by said well.

Apart from the foregoing problems, previous standby water storage arrangements serving to supplement water supply systems have been plagued by constructions which lend themselves to poor turnover of the water being stored as well as to icing problems during wintertime operations. Icing is particularly destructive of related control and sensing equipment. These problems lead to a requirement for substantial and costly maintenance.

One further problem in connection with the use of standby water storage tanks as heretofore constructed and embodied in connection with water supply systems stems from the fact that the original filling thereof is normally a very slow and tedious procedure. The arrangement is usually such that a man has to stand at a gate valve in the line which extends from the source of supply to the tank and to constantly adjust the valve over a period of 24 to 36 hours while the tank is filled. During all this time he must watch a pressure gage and take immediate action as and when necessary to maintain line pressure in the related system.

In any event, the universal problem evidenced in prior art water supply systems is their inability to maintain at all times a supply of water for consumers which is adequate to meet their needs during peak demand periods and which is furnished under an adequate level of pressure.

It is to the solution of the aforementioned as well as other problems that the present invention is directed.

SUMMARY OF THE INVENTION

The present invention provides a highly economical and more effective substitute for the present standby storage installations used in connection with water supply systems. Its nature is such, moreover, that its application can oftentimes eliminate the need for an additional well or wells, as well as the expensive pumping and filter units which must be installed in connection with such wells. An incident of the use of the invention in this latter respect is that it results in a substantial conservation of energy.

Embodiments of the invention provide a dual standpipe construction and arrangement which can serve as an adjunct to and standby installation for a water supply system. The use thereof insures that the consumers in the community depending on the water supply system will be furnished with an adequate supply of water under a desired level of pressure at all times, even during peak demand periods. As will be seen, these results and benefits obtain without the inclusion of pilot valves, solenoid valves, hydraulic operated valves or complicated circuitry.

The preferred embodiment of the invention described herein has been applied to a water supply system for a community of approximately 40,000 people. The standpipe structure utilized comprises an outer tank constituting a first standpipe, in this case having a capacity of approximately 1.5 million gallons of water, interiorly of which is positioned a second standpipe. The latter has a relatively small diameter while its height is less than that of the first standpipe. This smaller diameter standpipe serves as an influent line through which the outer standpipe may be filled. For delivery of water from the interior of the outer standpipe to a main in an associated water supply system there are two distribution lines. One such line is connected to open at one end thereof to the bottom of the outer standpipe, at its center. The other distribution line opens into the side of the outer tank, in an area of its interior adjacent the bottom. The latter of the distribution lines embodies a variable speed constant pressure pump under the control of various sensor means embodied in connection with the influent line.

The arrangement is such that the inner or small diameter standpipe serves as a medium through which water may be directed from the source utilized in the related water supply system to fill the outer standpipe. Suitable control means are provided to terminate the flow of water from the source when the water reaches a certain level within the outer standpipe. The distribution line which connects directly into the bottom of the outer standpipe serves as a medium through which water from the tank may be delivered into the related main in the event the pressure head, dependent on the level of water in the tank, is greater than the pressure in the related main. A check valve is provided in this distribution line which is arranged to normally be closed in the event the pressure in the related main is at an adequate level. By contrast, the pump in the other distribution line is the operative unit in the standby system provided in connection with the nested standpipes. It is so arranged to insure that as the pressure in the main of the related supply system falls below a predetermined level, as sensed by the level of water in the influent line, the pump will be energized and variably controlled, the net result of which is to maintain a desired supply of water in the related system, and under a required and substantially uniform pressure.

It will be seen that the system is such that the pump referred to will automatically function as and when required to insure a generally uniform water service for consumers. The conditions in use of the invention apparatus are therefore quite distinct from the conditions in utilizing a conventional standby installation, wherein at most only a relatively small portion of the standby water may be effectively utilized to maintain pressure in a related system.

It is therefore a primary object of the invention to provide for use in connection with a water supply system wherein pumping means draws water from a source and supplies it to various consumers by way of a main and branch lines from a main, a supplement to said supply system which is economical to fabricate and install, more efficient and satisfactory in use, adaptable to a wide variety of applications and unlikely to malfunction.

A further object of the invention is to provide a new dual standpipe structure for use in storing water in connection with a conventional water supply system which can be uniquely related to the supply system so as to insure a delivery to consumers of an adequate amount of water under adequate pressure at all times, and for a significant period of time under emergency conditions where water is not available from the primary source of supply.

A further object of the invention is to provide apparatus serving as a supplement to a conventional supply system embodying the features of construction and the means and mode of their use herein described.

With the above and other incidental objects in view as will more fully appear in the specification, the invention intended to be protected by Letters Patent consists of the features of construction, the parts and combinations thereof, and the mode of operation as hereinafter described or illustrated in the accompanying drawings, or their equivalents.

Figure 2:
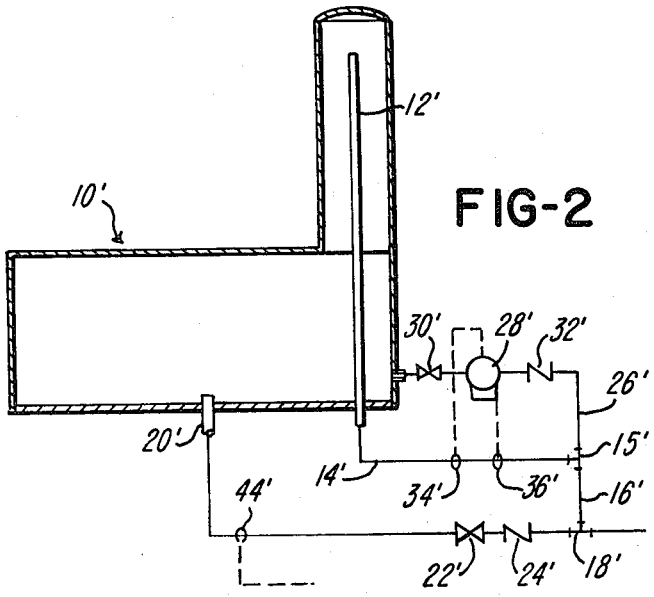

Referring to the drawings which illustrate one but not necessarily the only form of embodiment of the invention, FIG. 1 illustrates a dual standpipe structure such as contemplated by the present invention, the same being shown in generally diagrammatic fashion and in conjunction with the basic controls by means of which the contents thereof may be communicated with a main in a related water supply system; and FIG. 2 is a drawing to illustrate a slight modification of the invention embodiment shown in FIG. 1.

Like parts are indicated by similar characters of reference throughout the several views.

The embodiment of the invention diagrammatically illustrated in FIG. 1 of the drawings may be utilized in connection with and as an adjunct to any conventional water supply system comprised of one or more pumping units which draw water from a primary source and furnish it to consumers by way of a main and connecting branch lines. While the concept of the invention may be utilized in connection with a water system of any size, for convenience of description as well as for a better understanding of the invention it will be described as applied to a system serving a community of approximately 40,000 people.

As shown in FIG. 1, embodiments of the invention include a large storage tank 10 forming a first standpipe which houses interiorly thereof a second vertically oriented standpipe 12 which has a relatively small diameter and is positioned in spaced parallel relation to the central vertical axis of the tank 10. The standpipe 12 is positioned relatively adjacent the peripheral wall of the tank 10 to facilitate its connection to the wall by vertically spaced brackets (not shown) to maintain the vertical position thereof. Such brackets will be of a nature to have sufficient play to permit expansion and contraction thereof in use, a condition that will exist in view of the varying conditions of temperature to which the outer standpipe is exposed as well as to the varying temperature of the water which may be stored therein.

In the application referred to above the tank 10 will be 100 ft. high and have a diameter of 50 ft. while the height of the standpipe 12 will be 92 ft. and its diameter 12 inches.

Connected into the bottom of the standpipe 10, at its center, is one end of a conduit 20 which is suitably extended to connect to one end of the head of a tee fitting 18 to the opposite end of which a line is provided the remote end of which is coupled into the main of the water supply system to which the invention apparatus is applied. Incorporated in the conduit 20 between the end thereof which opens to the interior of the standpipe 10 at its bottom and the end thereof which connects to the tee fitting 18 is a gate valve 22 and a check valve 24. The conduit 20, as will be further described, serves as a distribution line through which water may pass from the tank 10 to the associated main. As will be obvious the check valve 24 will serve to prevent reverse flow and the gate valve 22 may be adjusted to meter flow as and when required.

Conduit means defining a second distribution line 26 has one end thereof connected in the peripheral wall of the standpipe 10 to open to the chamber defined thereby in an area thereof adjacent and spaced from its bottom. The opposite end of the conduit means 26 is connected by way of the head of a tee fitting 15 with a conduit 16 which forms a continuation thereof and eventually connects to the leg portion of the tee fitting 18. Thus, the fitting 18 serves as a means to commonly communicate the conduits 20 and 26 with the main line of the water supply system in which the illustrated apparatus is incorporated. A further conduit defines a line 14 which is coupled at one end thereof to the lower open end of the standpipe 12 and at the other end thereof to the leg of the tee fitting 15. In this manner the standpipe 12 is also placed in communication with the associated water supply system by the fitting 18. It will be obvious, therefore, that the plumbing involved in the application of the invention apparatus to a conventional water supply system is of a minimal nature. Incorporated in the conduit 26 is a variable speed constant pressure booster pump 28. Further incorporated in the conduit 26 is a gate valve 30 which is interposed between the suction side of the pump 28 and that end of the conduit which opens into the standpipe 10. Included in the conduit 26 between the discharge side of the pump 28 and the tee fitting 15 is a check valve 32. The latter, as will be obvious, is of a nature to permit flow from the discharge side of the pump but prevent reverse flow.

Additionally illustrated in FIG. 1 are two sensors 34 and 36. As will be seen, the sensor 36 functions under the influence of the level of water in the standpipe 12 to automatically control the starting and stopping of the pump 28. The sensor 34, on the other hand, is connected with the booster pump 28 to control and vary the speed thereof, also in accordance with the pressure head of the water within the standpipe 12.

The foregoing structure diagrammatically illustrated is basically all that is required to produce significant improvements in the capabilities of service through a conventional water supply system. In the function thereof, as noted, the standpipe 12 provides an influent line through which the outer standpipe 10 may be filled and through which the amount of water stored in the outer standpipe may be replenished during the function of the related water supply system. At the time the dual standpipe structure shown is first put into use a pumping unit or units at the source of the related water supply system will be energized to pump water by way of the head of the tee fitting 18, the connecting line 16 and by way of the tee fitting 15 and line 14 to the bottom of the standpipe 12. As the water is pumped the check valves 24 and 32 will effectively preclude water passing these valves and moving into the bottom of the standpipe 10 by way of the distribution lines defined by the conduits 26 and 20. As water is pumped from the source it will rise in the standpipe 12 until it overflows and drops to the bottom and gradually fills the interior of the tank 10. In accordance with the invention, suitable means will be provided in the form of a telemetering sensor device 44 which will respond to the water in the standpipe 10 reaching a 100 ft. level to signal the controls for the pumping unit or units at the source to stop pumping.

During use of the water supply system, if the pressure in the main into which the invention apparatus is coupled should fall below the head pressure provided by the level of the water in the standpipe 10, then, under the influence of gravity water will flow from the tank 10 and to the main by way of the distribution line provided by the conduit 20. In the example illustrated, if the pumping unit or units at the source should not be energized at the time water is supplied to the main from the standpipe 10, as soon as the level of the water in the standpipe 10 drops to 94 ft., the telemetering device 44 will function to signal the main pumping unit at the source to start pumping. Of course, once the pressure in the main is brought up to an appropriate level by reason of the operation of the pumping units at the source, water will no longer flow to the main by way of the distribution line 20.

If in the operation of the related water supply system there should be a period of unusually high demand by consumers, under which conditions the pump or pumping units at the source are unable to supply sufficient water to the consumers under adequate pressure, this will be reflected not only in the outer standpipe 10 but in the inner standpipe 12. In the case illustrated, should the water in the standpipe 12 have the upper level thereof drop to 91 ft., the pressure sensor 36 will respond to cause the energization of the pump 28, whereupon the pump 28 will draw water from the interior of the standpipe 10, adjacent its bottom and pump the same by way of the conduit 26, fitting 15, line 16 and fitting 18 to and through the line which connects the fitting 18 to the associated main. If the upper level of the water in the standpipe 12 should raise or lower in response to conditions in the associated main with which it is in constant communication, this will be reflected by the sensor 34 appropriately changing the speed at which the pump 28 operates to insure that a required and predetermined pressure will be maintained in the main under the influence of the rate at which the pump 28 is drawing water from the supply in the standpipe 10, from adjacent its bottom. Should the consumers reduce their demand to a point that there is sufficient water in the main to cause the water in the standpipe 12 to rise to or above the 92 ft. level, the sensor 36 will then function to deenergize the pump 28.

It will be seen from the foregoing that in the event there is a power failure at the source by reason of which water cannot be pumped from the source into the associated main and its branch lines, as the pressure in the main will then have to depend upon the continued operation of the booster pump, the booster pump 28 can continue to function for a considerable period of time and to draw essentially the total capacity of the standpipe 10 from its interior and furnish it to maintain a reasonable level of pressure within the main and the associated branch lines. This is in distinct contrast to prior installations using storage tanks for standby water the arrangements of which rarely permit more than 25% of the storage tank capacity to be available for effective use in times of emergency.

It is believed that it will be clear that the supplement to a conventional water supply system as enabled by the invention apparatus such as here described will continuously monitor and continuously function in a manner to assure adequate pressure in the related main and its branch lines at all times, even during unusual demand periods. Even in the case of emergency, one can by reason of the application of the invention apparatus maintain adequate pressure for an extended period of time. During off peak periods, moreover, the arrangement provides that the small diameter standpipe 12 serves admirably and very advantageously as an influent line while on the other hand, when special demand indicates a need for a draw of water from the standpipe 10, then the line 20 and/or the line 26 incorporating the booster pump 28 come into function to provide that not only is water effectively supplied to the related water system to maintain the level of supply and under adequate pressure but the water which is supplied is drawn from the bottom of the tank. This insures a continuing turnover of the supply of the water in the tank whereby to avoid the type of stagnation and breeding as well as the possibility of icing of the water interiorly of the tank.

The invention therefore provides not only a safe and automatically functioning system but one which reduces normally anticipated levels of maintenance and replacement of control parts.

An added and most important feature of the invention is the economy in the application and use thereof. For example, in an application such as the example illustrated the addition of the improvements of the invention at nominal cost would provide improvements in service equal to that which would be afforded by an additional well together with rapid sand filters and a high service pumping unit, the estimated cost of which at this time is about $150,000. Not only is there a substantial savings in equipment but the invention improvements utilizing a 20 horsepower booster pump such as the pump 28 will do a job that would otherwise require 200 horsepower at the associated treatment plant.

To realize the efficiency of the invention system in the event of a major line failure, test usage of an installation such as illustrated proved that water could be drawn from the standpipe 10 to bring the level of the water therein down to 15 ft. and even to this level adequate pressures could be maintained on all portions of the related distribution system with no inconvenience to customers. The effectiveness of the invention can be particularly realized under such severe operating conditions.

The embodiment of the invention herein illustrated is detailed only to the extent necessary for an understanding of the invention. The sensor devices and the associated equipment and their connections are not detailed since the mechanics involved are well known to anyone versed in this art. Nor is the basic water supply system illustrated for the same obvious reasons. All one needs to communicate the invention apparatus to a main of the system is to provide conduit means to extend from the fitting 18 to couple into the main. As this is achieved the lines 20, 26 and 14 are simultaneously communicated with the main and thereby with its source of supply.

With the invention concepts available, one can moreover, readily modify an existing system employing a water storage tank to incorporate the improvements of the invention.

The modification of FIG. 2 of the drawings is identical in all respects, structurally and functionally, with that of FIG. 1, except that the outer standpipe 10' has a greater diameter and much lesser height except for a tube-like vertical extension to one side to accommodate the water to rise therein, in the case illustrated, to 100 feet, and to accommodate also the 92 foot standpipe 12'. The tank 10' such as shown is known as a ground water storage reservoir which during normal seasons will not require the operation of the booster pump 28. Embodying the apparatus of the invention, however, will enable the same function and benefits as described with reference to the embodiment as shown in FIG. 1.

From the above description it will be apparent that there is thus provided a device of the character described possessing the particular features of advantage before enumerated as desirable, but which obviously is susceptible of modification in its form, proportions, detail construction and arrangement of parts without departing from the principle involved or sacrificing any of its advantages.

While in order to comply with the statute the invention has been described in language more or less specific as to structural features, it is to be understood that the invention is not limited to the specific features shown, but that the means and construction herein disclosed comprise but one of several modes of putting the invention into effect and the invention is therefore claimed in any of its forms or modifications within the legitimate and valid scope of the appended claims.

The embodiments of the invention in which an exclusive property or privilege is claimed are defined as follows:

1. For use in connection with a water supply system wherein pumping means draws water from a source and supplies it to various consumers by way of a main and branch lines from a main, a supplement to said supply system including a tank forming a first large standpipe for storage of water, a second smaller standpipe, said second standpipe being positioned within said first standpipe to project upwardly from its bottom to a level approaching but spaced from the top of said first standpipe, a distribution line one end of which opens into the bottom of said first standpipe and the other end of which is arranged to connect to said main, the lower end of said second standpipe, which opens from the bottom of said tank, having coupled thereto one end of a first flow line the opposite end of which is arranged to connect to said main, said second standpipe providing means through which water may be delivered to fill or replenish the supply of water in the interior of said first standpipe, said distribution line providing means for the delivery of water from said first standpipe when the water therein reaches a predetermined level, and said second standpipe having in operative connection therewith means responding to the sensing of the water pressure in the related main, as represented by the level thereof in the second standpipe, to induce the delivery of water from said first standpipe to said main in a manner and under conditions to maintain the supply in said main and at a predetermined level of pressure such as required to satisfy the various consumers.

2. Apparatus as in claim 1 wherein a second distribution line is connected to open at one end to the bottom area of the interior of said first standpipe and arranged so that the other end thereof may be in communication with said main and said second distribution line embodies therein said means responding to the sensing of the water pressure in the related main.

3. Apparatus as in claim 2 wherein said first flow line is merged with said second distribution line at a point lying between said means responding to the sensing of the water pressure in the related main and means which provide for the connection of said lines to the said main.

4. Apparatus as in claim 2 wherein said means responding to the sensing of water pressure includes a pump connected into said second distribution line.

5. Apparatus as in claim 4 wherein at least part of said sensing means provides means responding to changing levels of the water in said second standpipe to induce a varying speed of said pump in a manner to provide that said pump draws water from said first standpipe in amounts adequate to maintain a required supply in said main and delivers the same to said main in a manner to maintain, substantially, a predetermined pressure in said main.

6. Apparatus as set forth in claim 1 characterized in that said sensing means is operative to maintain in said main a supply of water the level of pressure of which is substantially continuously controlled and held at a substantially uniform level.

7. Apparatus as set forth in claim 1 wherein means in connection with said first standpipe are arranged to connect with said pumping means of said water supply system and conditioned to provide for interruption of the operation of said pumping means when the water in said first standpipe reaches a predetermined high level.

8. Apparatus as set forth in claim 1 wherein sensing means in connection with said second standpipe are operatively connected to said means responding to the sensing of the water pressure in the related main, which is in the form of a variable speed constant pressure pump unit, to energize said pump unit on the occurrence of the water in said second standpipe dropping to a predetermined level.

9. Apparatus as set forth in claim 8 wherein said last mentioned sensing means include means for controlling the speed of said pump unit and for adjusting the same in correspondence with a changing level of the water in said second standpipe, within predetermined limits.

10. Apparatus as set forth in claim 9 wherein portions of said flow line and said first mentioned distribution line are merged to commonly communicate with the related main.

11. Apparatus as set forth in claim 10 wherein the first mentioned distribution line embodies valve means which are normally closed when the pressure in the related main and the supply of water therein is adequately furnished by the pumping means in the water supply system which draws water from said source and said normally closed valve means is adapted to open and provide for delivery of water from said first standpipe to said main when the level of water in said first standpipe provides a pressure head which is greater than the pressure in the related main.

12. Apparatus as set forth in claim 1 wherein a second distribution line embodies a pump comprising at least part of said means responding to the sensing of water pressure in the related main and said second distribution line is arranged to have one end portion extend from the suction side of the pump to a bottom interior area of said first standpipe and to have a portion thereof at the side of said pump remote from said first standpipe first merge with said opposite end of said flow line and then further merge with said first mentioned distribution line whereby to provide for a common connection of said lines with said main, a check valve is located in said first mentioned distribution line between said first standpipe and the point at which it merges with said second distribution line to prevent flow of water from said main to said standpipe by way of said first mentioned distribution line, a further check valve is located in said second distribution line to normally prevent flow from said main to said first standpipe by way of said second distribution line, and sensing means are provided to sense the level of water in said second standpipe which sensing means are connected to control said pump whereby to provide that as the water in said second standpipe moves to and between certain predetermined levels said pump will be selectively and automatically energized or deenergized, and caused while energized to draw water from said first standpipe and deliver it to said main in a manner to guarantee said main a required supply of water which supply is furnished under a level of pressure adequate to satisfy consumers, even during peak demand periods.

* * * * *